US007458835B2

(12) United States Patent
Kobayashi et al.

(10) Patent No.: US 7,458,835 B2
(45) Date of Patent: Dec. 2, 2008

(54) CONNECTOR AND A CONNECTOR ASSEMBLY

(75) Inventors: Yutaka Kobayashi, Yokkaichi (JP); Keiichi Nakamura, Yokkaichi (JP); Yutaka Noro, Yokkaichi (JP); Takahiro Kikuchi, Yokkaichi (JP); Yoshiyuki Ishikawa, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/964,085

(22) Filed: Dec. 26, 2007

(65) Prior Publication Data

US 2008/0153343 A1 Jun. 26, 2008

(30) Foreign Application Priority Data

Dec. 26, 2006 (JP) ..... 2006-349000

(51) Int. Cl.
*H01R 29/00* (2006.01)

(52) U.S. Cl. ..... 439/188; 439/489

(58) Field of Classification Search ..... 439/188, 439/489

See application file for complete search history.

(56) References Cited

U.S. PATENT DOCUMENTS 6,086,411 A * 7/2000 Shinozaki ..... 439/489
6,241,542 B1 * 6/2001 Nishide et al. ..... 439/188

FOREIGN PATENT DOCUMENTS

JP 3284200 3/2002

* cited by examiner

*Primary Examiner*—Tho D Ta
(74) *Attorney, Agent, or Firm*—Gerald E. Hespos; Anthony J. Casella

(57) ABSTRACT

A movable member (36) is located at a malfunction preventing position and a pair of functional terminals (25) are shorted by a shorting terminal (50) unless two housings (10, 20) are properly connected, whereas the movable member (36) is moved to a connection detecting position and the shorting terminal (50) shorts a pair of detection terminals (14) at the same time as being disengaged from the pair of functional terminals (25) when the two housings (10, 20) are properly connected. Since the shorting terminal (50) is commonly used to short the pair of functional terminals (25) for the malfunction prevention and the like and to short the pair of detection terminals (14) for the detection of a connected state of the two housings (10, 20), the number of parts can be reduced.

10 Claims, 17 Drawing Sheets

CONNECTOR AND A CONNECTOR ASSEMBLY

BACKGROUND OF THE INVENTION

1. Field of the Invention

The invention relates to a connector and to a connector assembly.

2. Description of the Related Art

Japanese Patent No. 3284200 discloses a connector for an airbag circuit of an automotive vehicle. The connector has a first shorting terminal in an airbag side housing for shorting two terminal fittings of an airbag circuit to prevent a malfunction of the airbag when the two housings of the connector are separated for maintenance or other reason. Further, two detection terminals are provided in the power-supply side housing for confirming the connection of the two housings, and a second shorting terminal is provided in the airbag side housing for shorting the detection terminals when the two housings are connected properly.

The shorting terminal for preventing the malfunction of the airbag and the shorting terminal for detecting the connected state of the housings are provided separately in the above-described connector, thereby increasing the number of parts and the cost.

The invention was developed in view of the above situation, and an object thereof is to reduce the number of parts.

SUMMARY OF THE INVENTION

The invention relates to a connector with a housing connectable with and separable from a mating housing. The connector further includes at least two detection terminals and two pair of terminal fittings. A movable member is provided movably in the housing and a shorting terminal is movable together with the movable member. The shorting terminal is designed to contact and short the terminal fittings when the movable member is at a malfunction preventing position and to contact and short the detection terminals that have entered the housing when the movable member is at a connection detecting position.

The connector preferably comprises a switching means for holding the movable member at the malfunction preventing position unless the housings are connected properly while releasing the movable member from the malfunction preventing position and moving the movable member to the connection detecting position when the housings are connected properly.

A biasing mean preferably is provided for biasing the movable member towards the connection detecting position.

A holding means may be provided for holding the movable member at the malfunction preventing position until the housings are connected properly.

The housing preferably includes at least one partition wall partitioning the shorting terminal and the terminal fittings when the movable member is moved to the connection detecting position.

At least one guiding groove extends substantially straight in forward and backward directions in the housing and preferably in the partition wall. The guiding groove guides resilient contact pieces of the shorting terminal.

The shorting terminal preferably is mounted to the movable member by inserting a main portion of the shorting terminal into a mount groove of the movable member.

The invention also relates to a connector assembly comprising the above-described connector and a mating connector connectable therewith. The mating connector has a mating housing with at least one pair of detection terminals therein.

A force accumulating means preferably is provided in the mating housing for accumulating a biasing force in the biasing means as the housings are connected.

A releasing means preferably is provided in the mating housing for releasing the movable member from the held state and permitting the movable member to move towards the connection detecting position by the biasing of the biasing means substantially when the housings are connected properly.

The detection terminals preferably are in the housing and the terminal fittings preferably are in the mating housing.

A prior art connector has a shorted state of a pair of terminal fittings for the malfunction prevention released before the two housings are connected properly. In such a connector, there is a likelihood that a potential difference produced between the terminal fittings will cause a malfunction of an airbag or the like if a circuit is not closed between the housings when the shorted state of the terminal fittings is released.

On the contrary, the movable member of the subject invention is held at the malfunction preventing position and the terminal fittings are shorted by the shorting terminal so that the malfunction preventing state is held until the two housings are connected properly. The movable member is moved to the connection detecting position when the two housings are connected properly. As a result, the shorting terminal shorts the detection terminals to set a connection detecting state and, simultaneously, the shorted state (malfunction preventing state) of the terminal fittings by the shorting terminal is released. Accordingly, when the shorted state for the malfunction prevention is released, the two housings already are connected properly and the circuit between the two housings already is closed. Therefore, there is no likelihood of malfunction.

The switching means preferably includes biasing means in the mating housing for biasing the movable member towards the connection detecting position, force accumulating means in the housing for accumulating a biasing force in the biasing means as the housings are connected, holding means in the mating housing for holding the movable member at the malfunction preventing position until the housings are connected properly, and releasing means in the housing for releasing the movable member from the held state by the holding means and permitting the movable member to move towards the connection detecting position by the biasing of the biasing means at the same time that the housings are connected properly.

The force accumulating means accumulates a biasing force in the biasing means in the process of connecting the two housings and while the movable member is held at the malfunction preventing position. The movable member is moved to the connection detecting position at a stroke by the biasing force of the biasing means when the two housings are connected properly. The biasing force of the biasing means ensures that the movable member is moved reliably to the connection detecting position.

The mating housing preferably includes a partition wall partitioning the shorting terminal and the two terminal fittings when the movable member is moved to the connection detecting position.

The shorting terminal and the two terminal fittings are partitioned by the partition wall with the two housings properly connected and the movable member moved to the connection detecting position. Therefore the shorted state of the terminal fittings by the shorting terminal can be released reliably.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
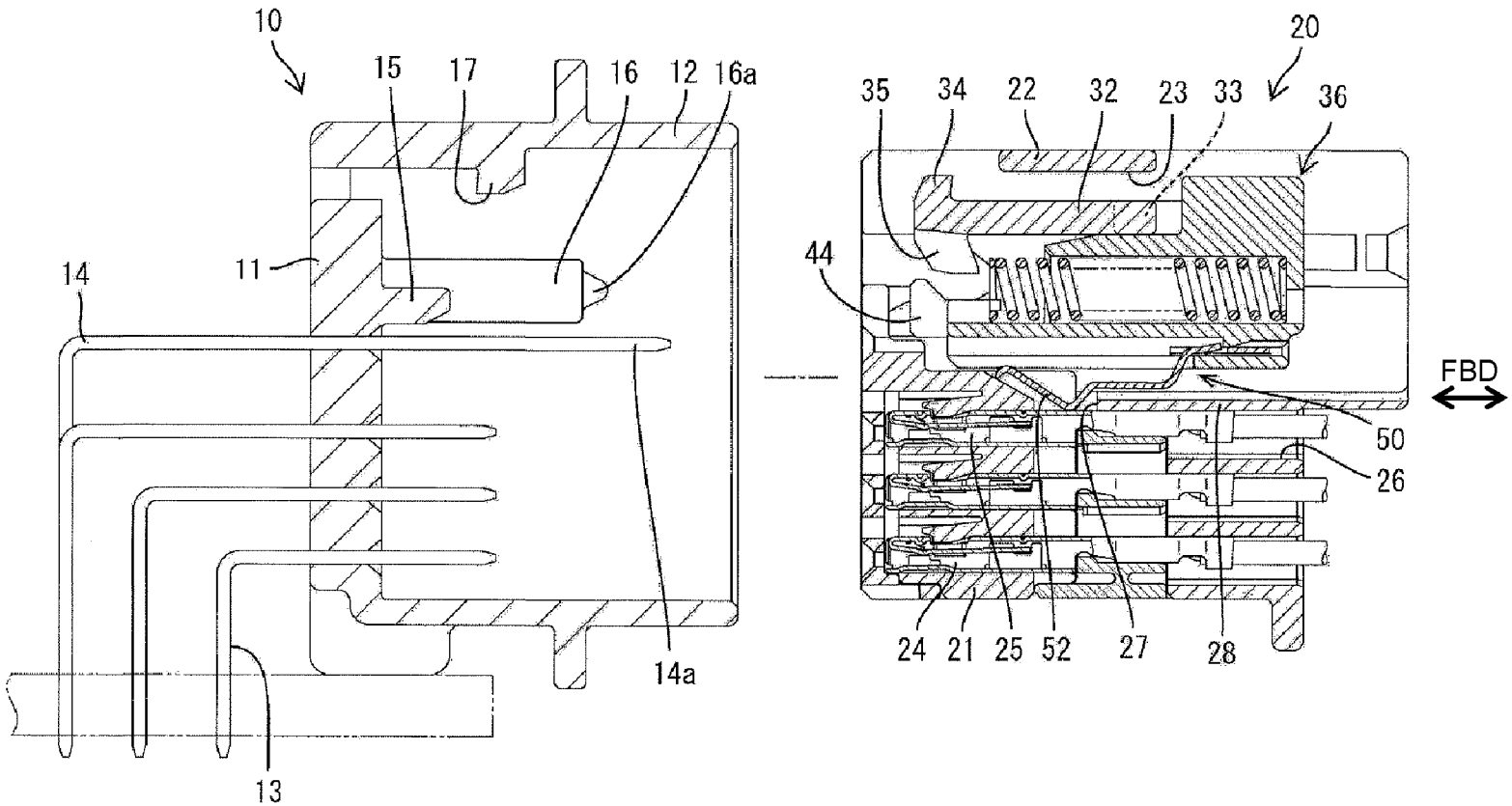
FIG. 1 is a section showing a separated state of two male and female housings in one embodiment.
Figure 2:
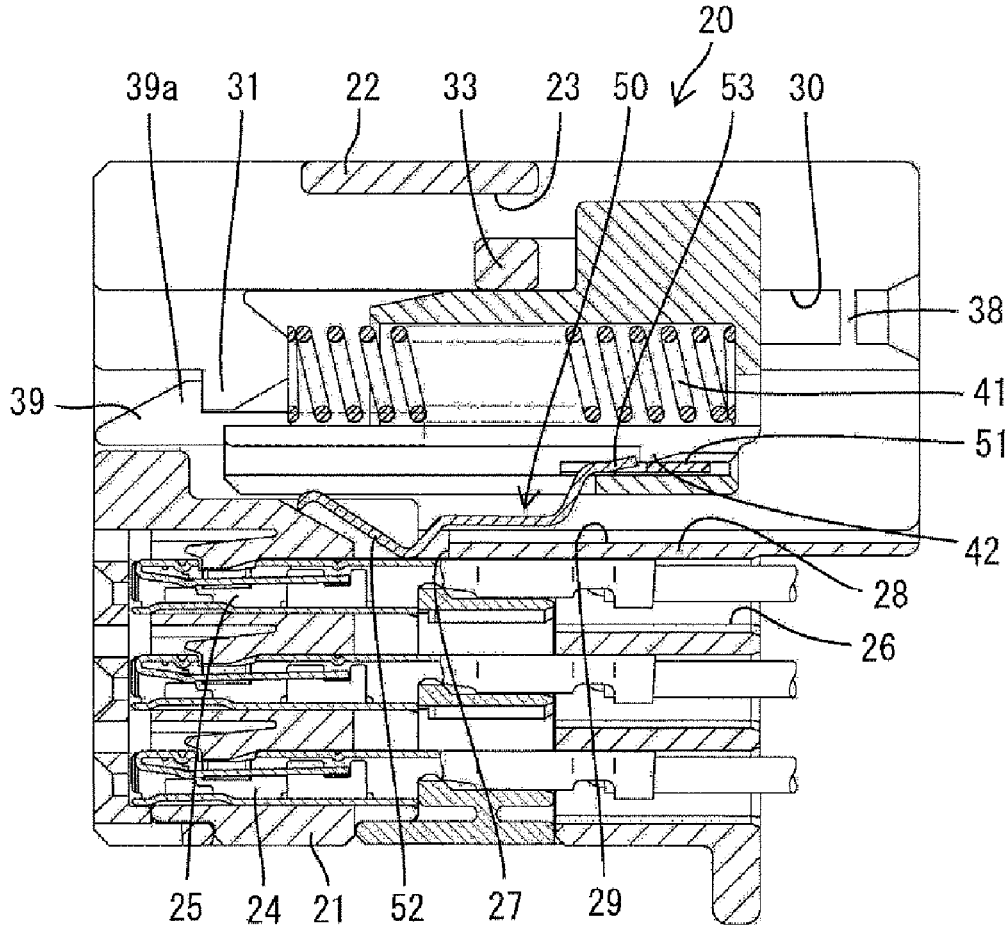
FIG. 2 is a section of the female housing.
Figure 3:
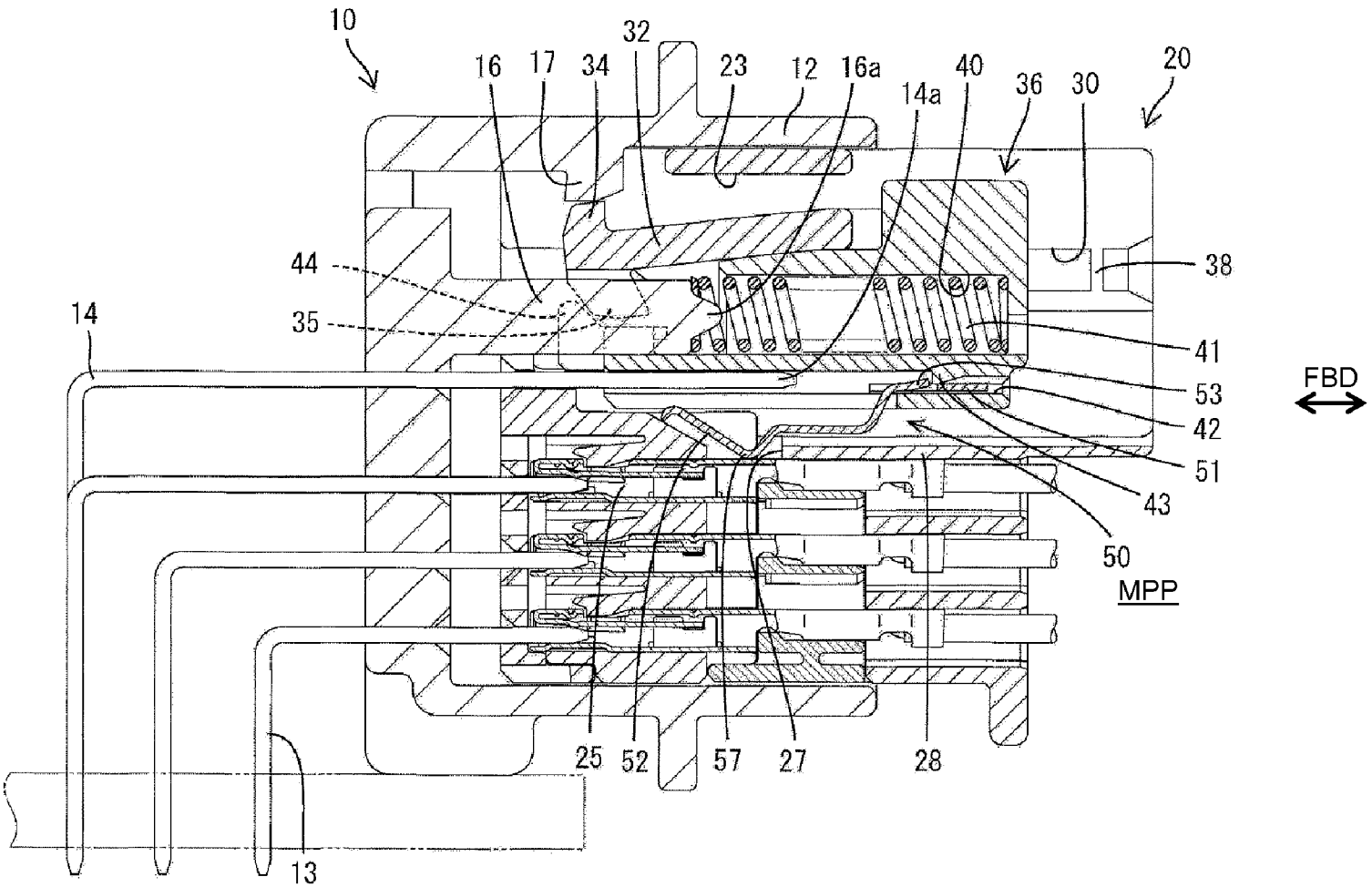
FIG. 3 is a section showing an intermediate state of a connecting operation of the two housings.
Figure 4:
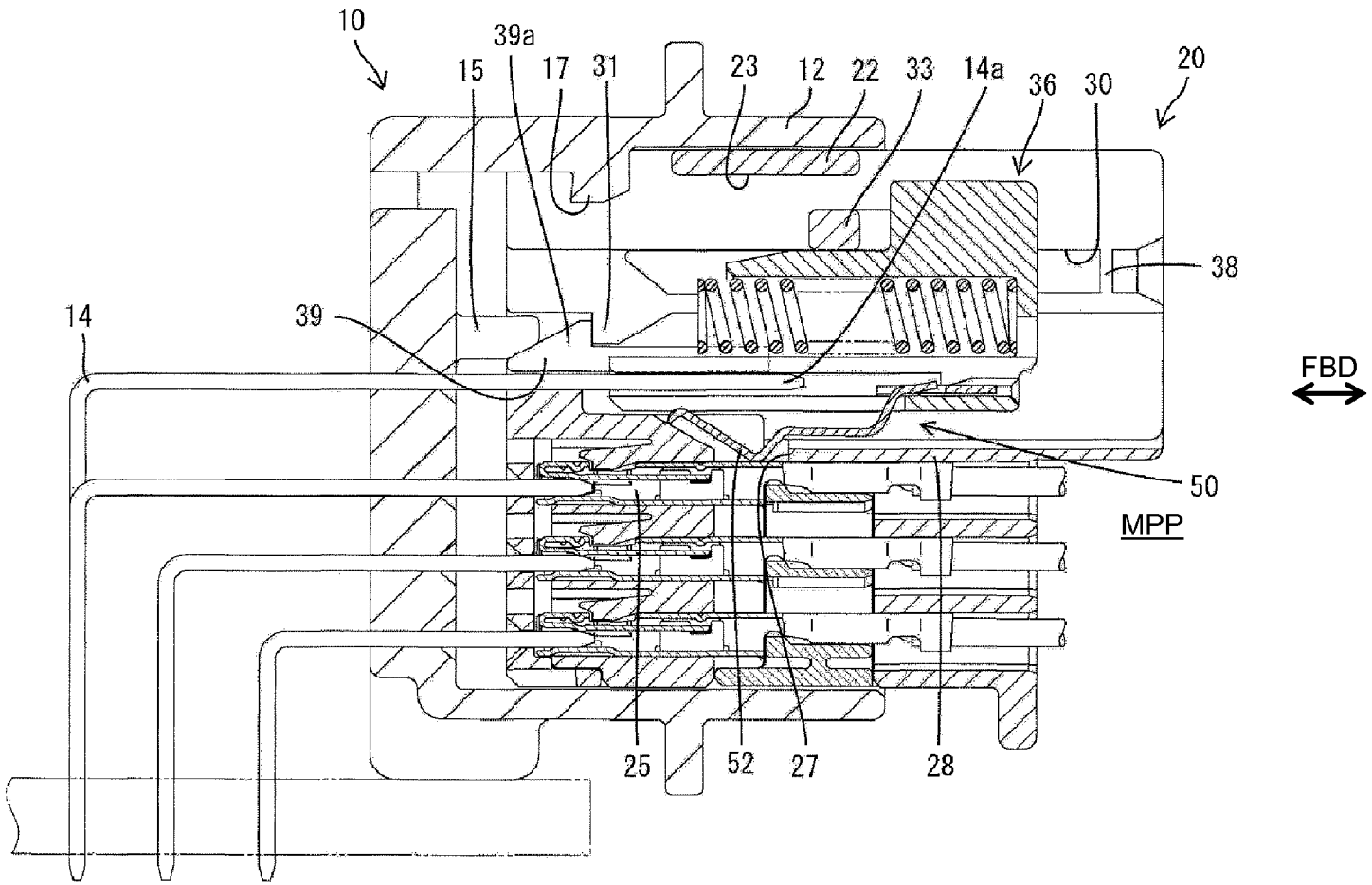
FIG. 4 is a section showing the intermediate state of the connecting operation of the two housings.

A connector in accordance with the invention includes male and female housings that are identified respectively by the numerals 10 and 20 in FIGS. 1 to 17. The housings 10, 20 are connectable with and separable from each other. Connecting ends of the housings are referred to as the front.

The male housing 10 is made e.g. of synthetic resin and includes a terminal holding wall 11 and a rectangular tubular receptacle 12 that projects forward from the outer peripheral edge of the terminal holding wall 11. L-shaped male terminal fittings 13 and L-shaped left and right detection terminals 14 penetrate the terminal holding wall 11. Front sections of the male terminal fittings 13 and front sections of the detection terminals 14 are accommodated in the receptacle 12. Left and right releasing pieces 15 project forward at positions adjacent to and above the detection terminals 14 on the front surface of the terminal holding wall 11 and at the back end of the receptacle 12. A pressing projection 16 projects forward from intermediate positions of the left and right releasing pieces 15. The projecting end of the pressing projection 16 is more forward than the projecting ends of the releasing pieces 15. A protrusion 16*a* projects from the front end surface of the pressing projection 16. An engaging portion 17 is formed on the upper wall of the receptacle 12 to project down and inward of the receptacle 12. The engaging portion 17 is at substantially the same position as the pressing projection 16 in the transverse direction. Horizontal sections 14*a* of the left and right detection terminals 14 are near the pressing projections 16 and are slightly below the pressing projection 16 and the releasing pieces 15. Front ends of the detection terminals 14 are more forward than the protrusions 16*a* of the pressing projections 16.

The female housing 20 is made e.g. of synthetic resin and is in the form of a block. A terminal accommodating portion 21 is defined at a lower part of the female housing 20 and female terminal fittings 24 are arrayed vertically and transversely in the terminal accommodating portion 21 for connection with the male terminal fittings 13. A substantially box-shaped portion 22 is defined on an upper part of the female housing 20 and has an operation space 23 for accommodating a movable member 36.

Female terminal fittings 24 are accommodated in the terminal accommodating portion 21. Additionally, functional terminals 25 are disposed in cavities 26 at a transverse intermediate position of the uppermost stage. The functional terminals 25 form part of a circuit for an electric device, such as an automotive airbag, and detect the connection of the two housings 10, 20. Cutouts 27 are formed in the upper walls of cavities 26 so that the cavities 26 communicate with the operation space 23 A partition wall 28 is defined in an area behind the cutout 27 and partitions the cavity 26 and the operation space 23. Left and right guiding grooves 29 are formed in the upper surfaces of the partition walls 28 and extend substantially straight in forward and backward directions FBD. The guiding grooves 29 function to guide resilient contact pieces 52 of a shorting terminal 50 to prevent transverse movements or inclinations when the movable member 36 moves forward and backward.

The operation space 23 is open at the front and rear end surfaces of the female housing 20 and guide grooves 30 are formed in the inner surfaces of the left and right walls of the box-shaped portion 22 that defines the operation space 23. The guide grooves 30 extend substantially straight in forward and backward directions FBD parallel to connecting and separating directions of the housings 10, 20. Two holding portions 31 are formed on the inner surfaces of the left and right walls of the box-shaped portion 22 at positions adjacent to and below the guide grooves 30. A lock arm 32 is cantilevered forward in the operation space 23 from couplings 33 on the left and right walls of the box-shaped portion 22. Thus, the front end of the lock arm 32 can be deformed resiliently up and down in directions intersecting the forward and backward directions FBD. A lock 34 projects up and two return receiving portions 35 projecting down near the front end of the lock arm 32.

The movable member 36 is made e.g. of synthetic resin and is accommodated in the operation space 23 for movement in forward and backward directions FBD between a malfunction preventing position MPP and a connection detecting position CDP. Two guide ribs 37 extend in substantially forward and backward directions FBD on the outer left and right surfaces of the movable member 36 and engage the guide grooves 30. The guide ribs 37 contact the front ends of the guide grooves 30 to prevent forward movement of the movable member 36 beyond the malfunction preventing position MPP. The rear ends of the guide ribs 37 engage stoppers 38 at the rear ends of the guide grooves 30 to prevent rearward movement of the movable member 36 beyond the connection detecting position CDP.

Left and right holding pieces 39 cantilever forward from left and right surfaces of the movable member 36 at positions below the guide ribs 37. The holding pieces 39 can deform resiliently up and down in directions intersecting the forward and backward directions FBD. Holding projections 39*a* project up at the front ends of the holding pieces 39. Left and right return pressing portions 44 project forward from the front end surface of the movable member 36. Spring accommodating spaces 40 extend in forward and backward directions FBD in the movable member 36 and are open at the front and rear of the movable member 36. Each spring accommodating space 40 has a substantially round shape when viewed from the front. A substantially cylindrical compression coil spring 41 is disposed in each spring accommodating space 40 and has an axial line that extends in substantially forward and backward directions FBD. The spring 41 is resiliently deformable in forward and backward directions FBD without shaking significantly in vertical or transverse directions. Left and right front retaining walls are formed at the front end of each spring accommodating space 40 to prevent the compression coil spring 41. A rear retaining wall is formed at the rear end of each spring accommodating space 40 for preventing the compression coil spring 41 from coming out rearwardly from the spring accommodating space 40.

A mount groove 42 extends in forward and backward directions FBD along the bottom surface of the movable member 36 and a retaining projection 43 is formed on the ceiling surface of the mount groove 42. The shorting terminal 50 is mounted in this mount groove 42.

Figure 5:
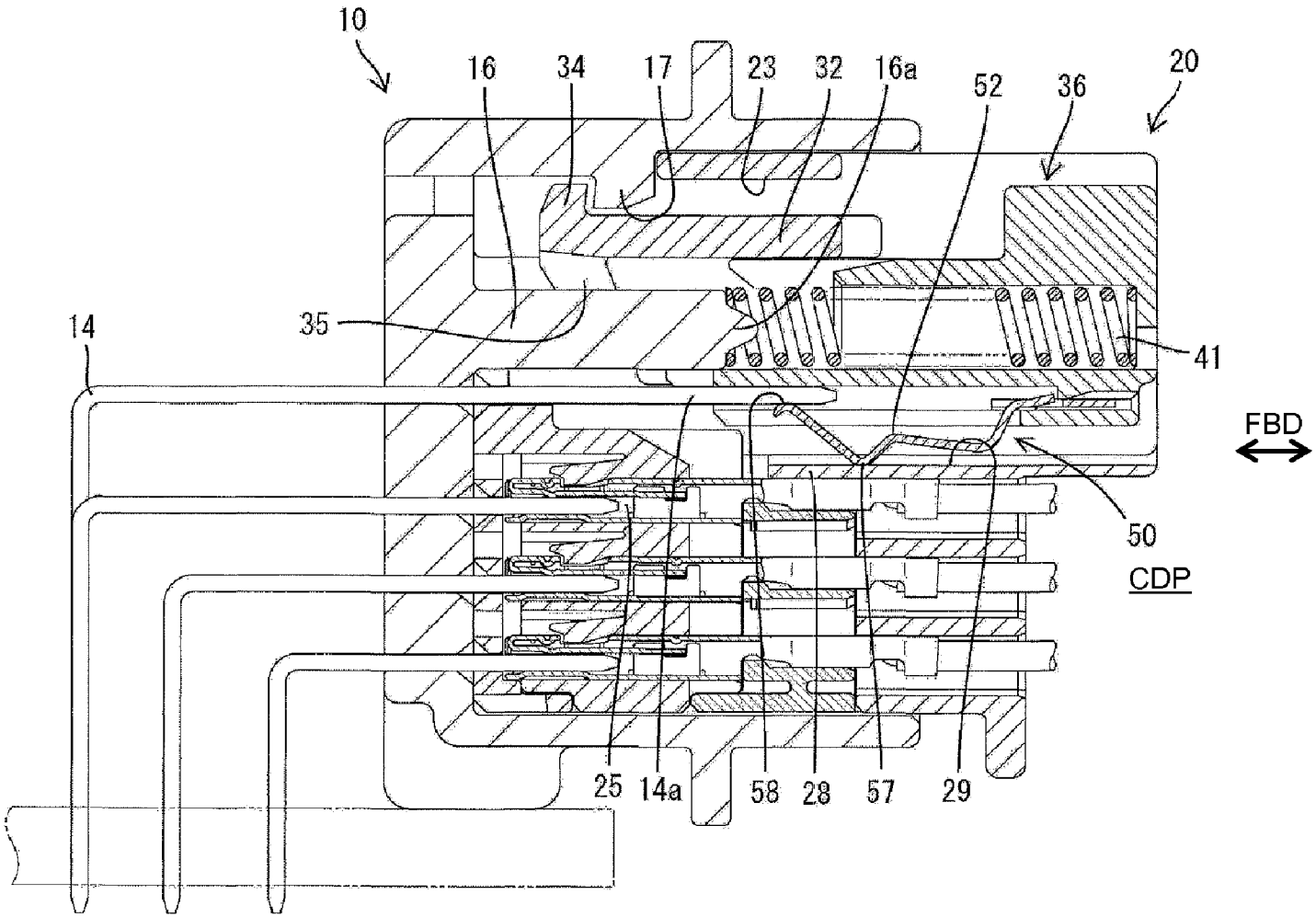
FIG. 5 is a section showing a state where the two housings are properly connected.
Figure 6:
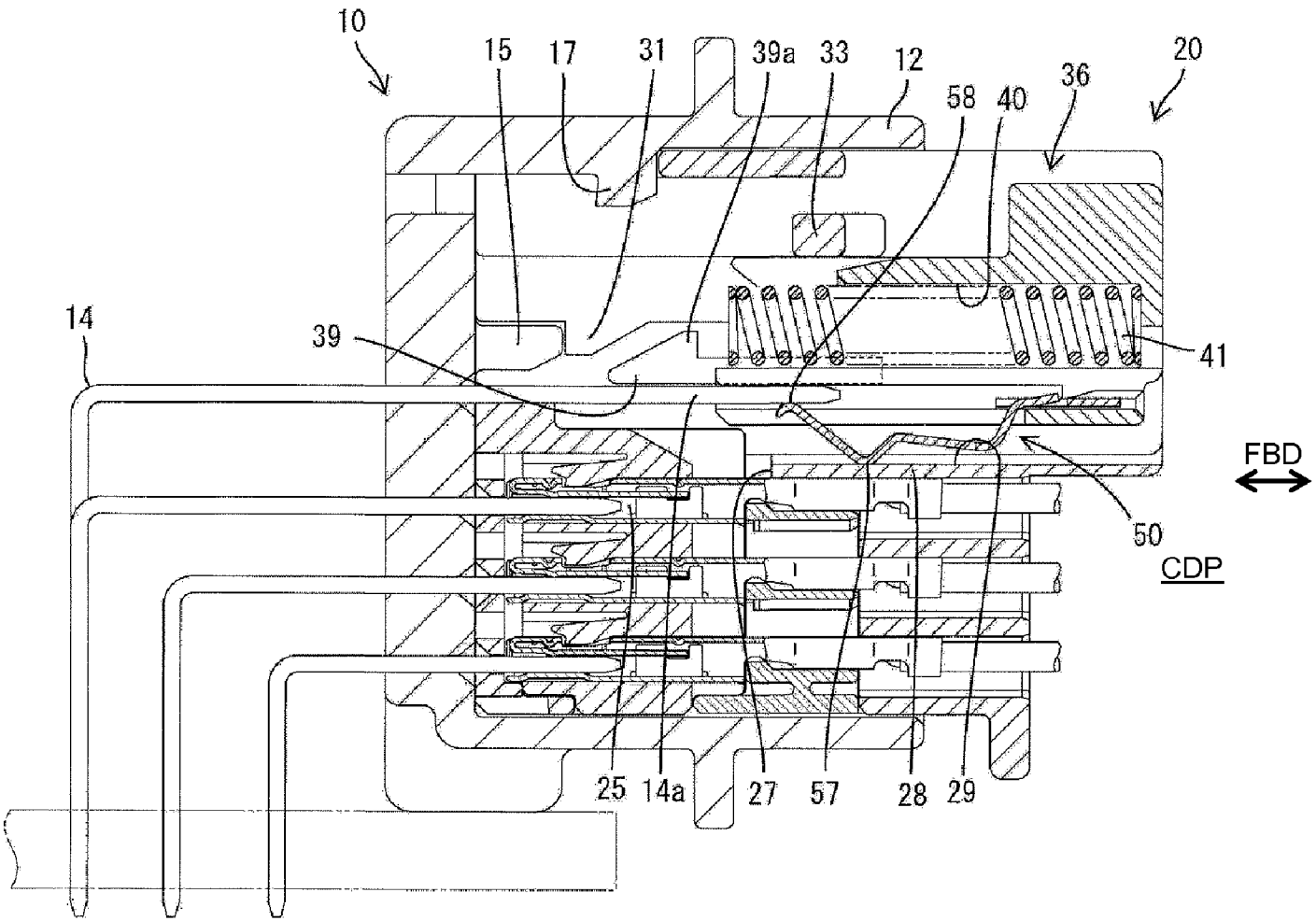
FIG. 6 is a section showing the state where the two housings are properly connected.
Figure 7:
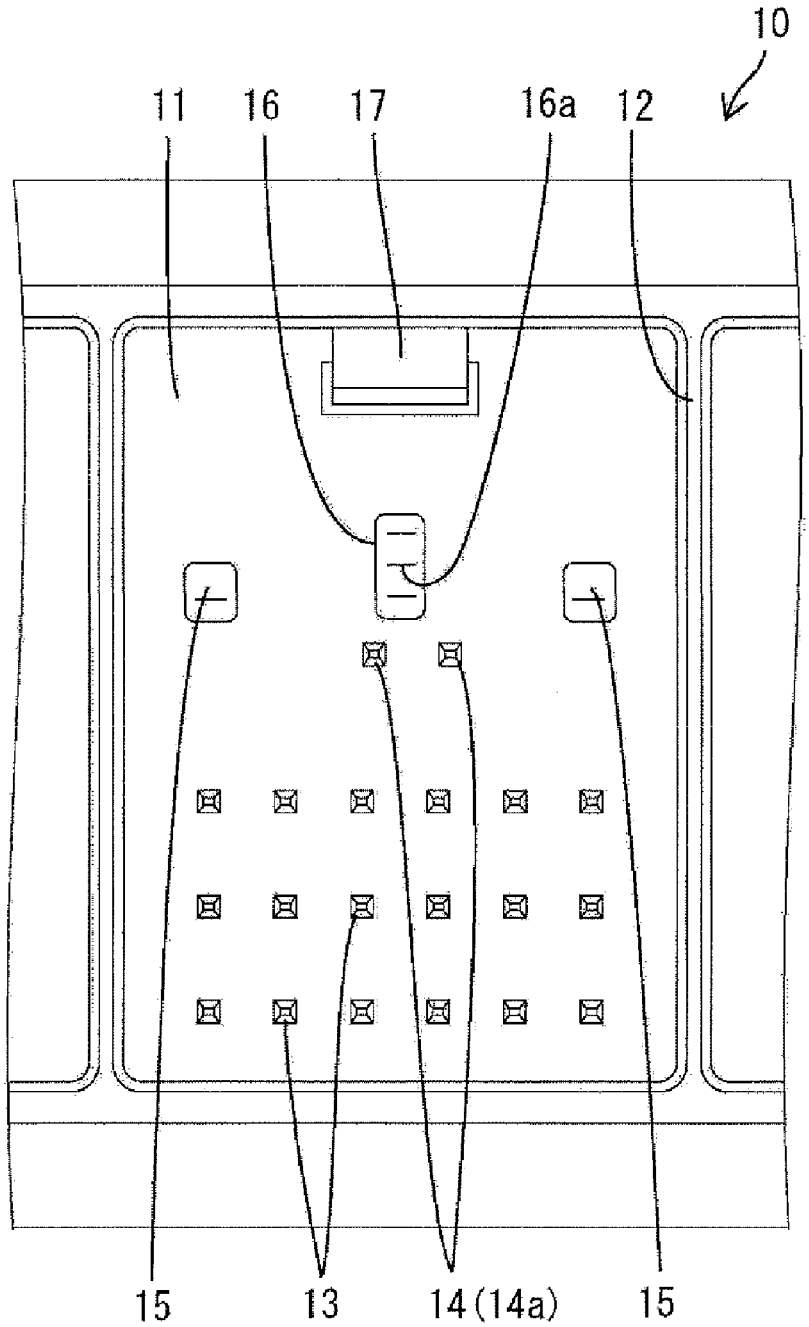
FIG. 7 is a front view of the male housing.
Figure 8:
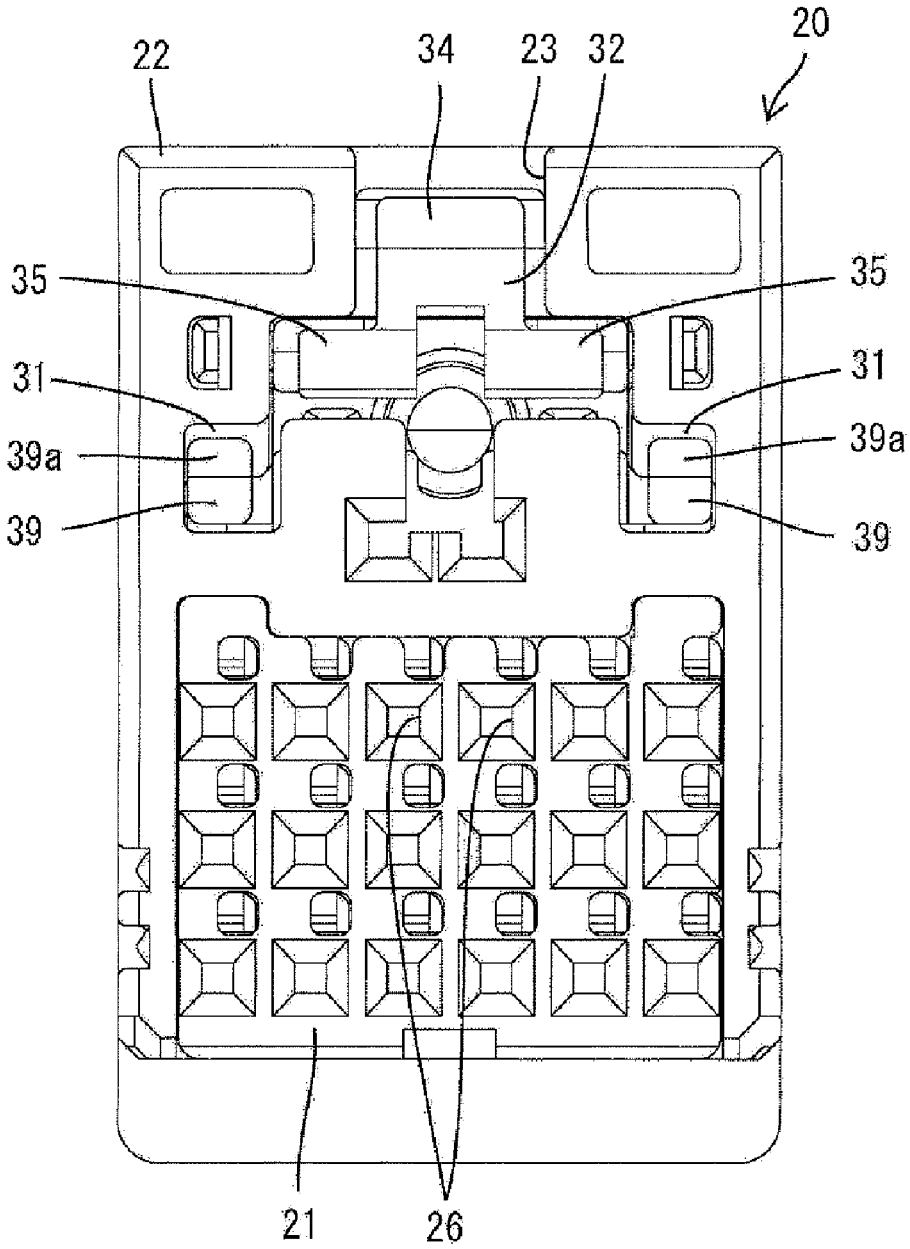
FIG. 8 is a front view of the female housing.
Figure 9:
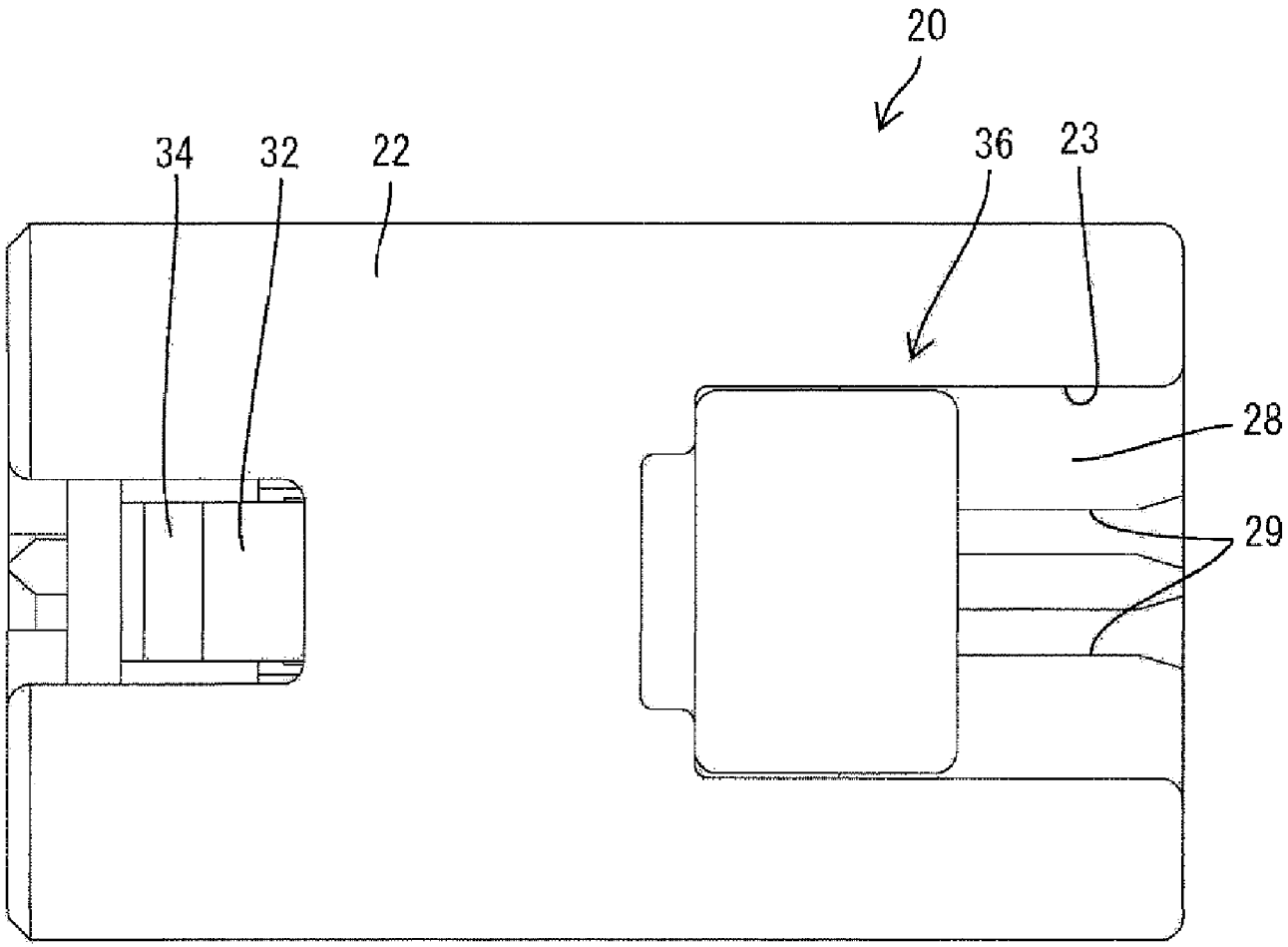
FIG. 9 is a plan view of the female housing.
Figure 10:
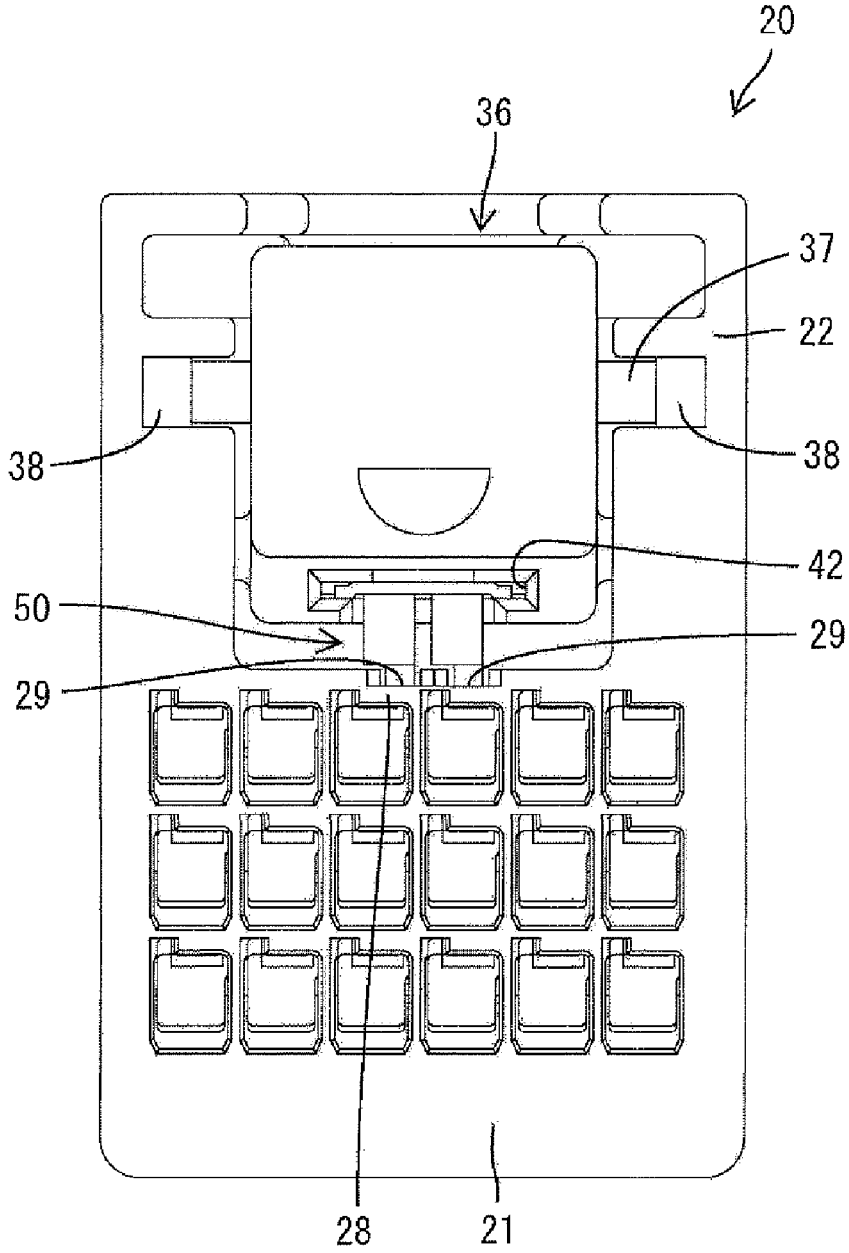
FIG. 10 is a rear view of the female housing.
Figure 11:
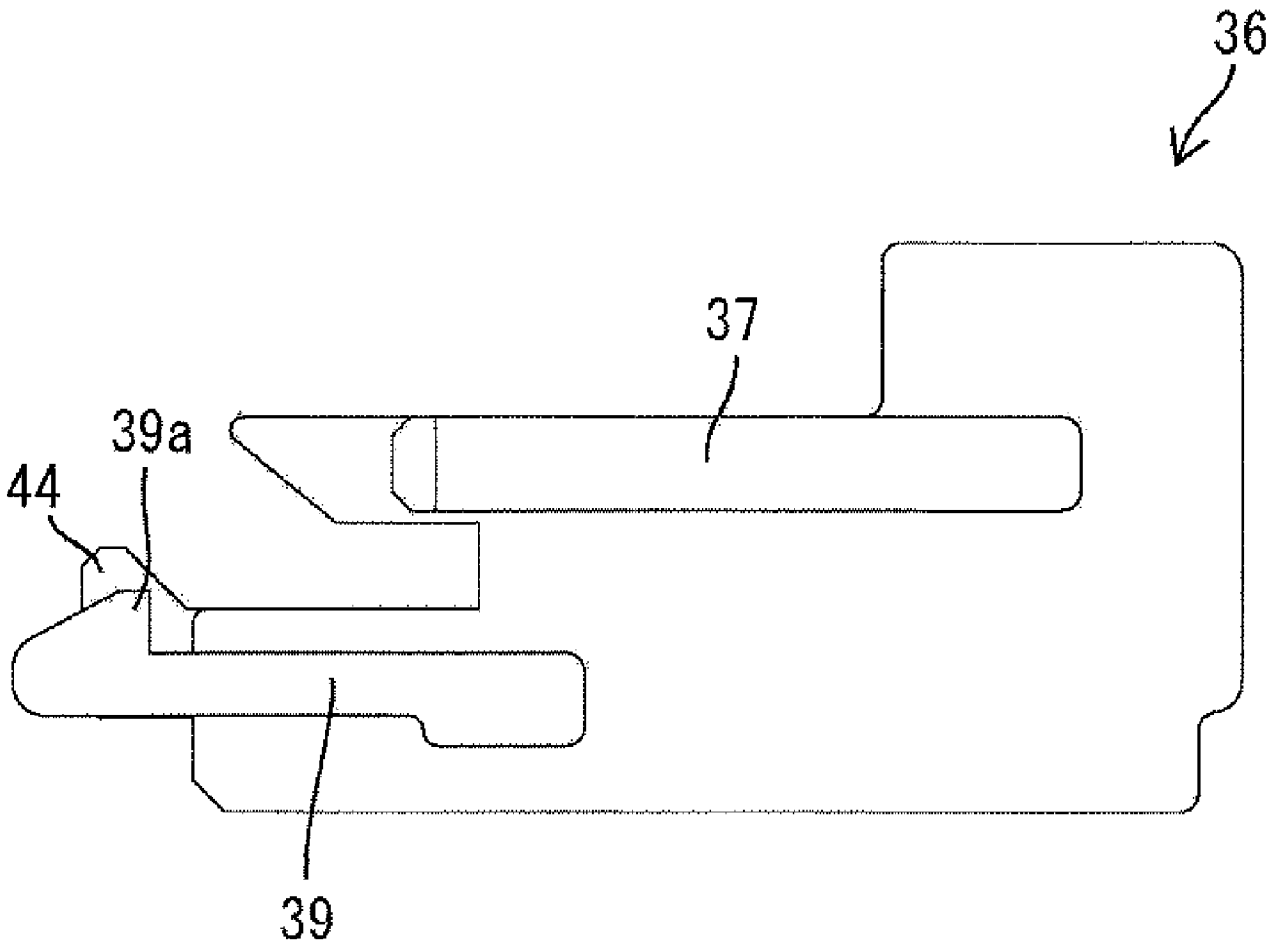
FIG. 11 is a side view of a movable member.
Figure 12:
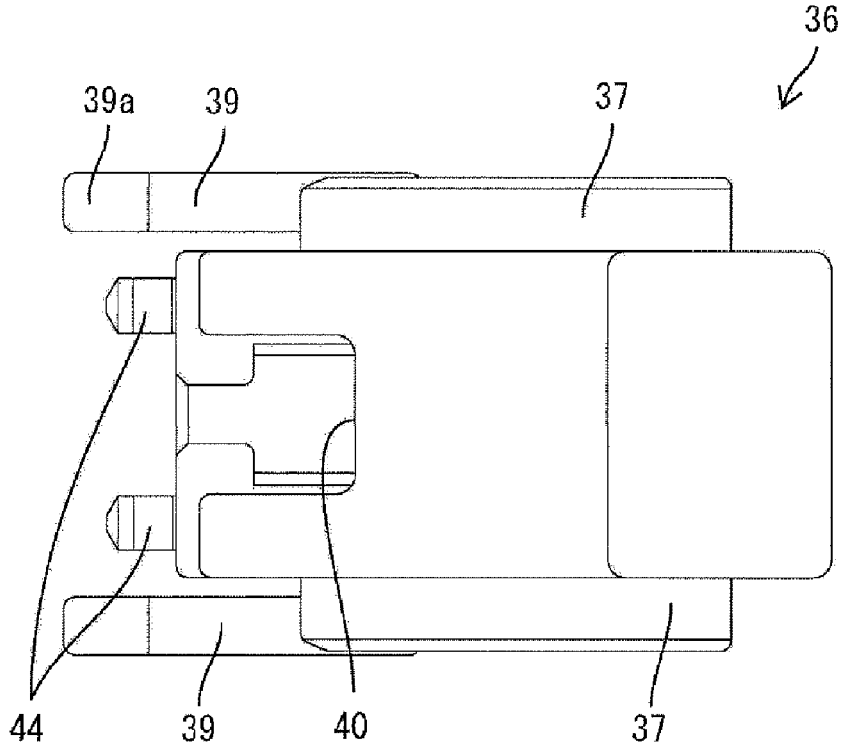
FIG. 12 is a plan view of the movable member.
Figure 13:
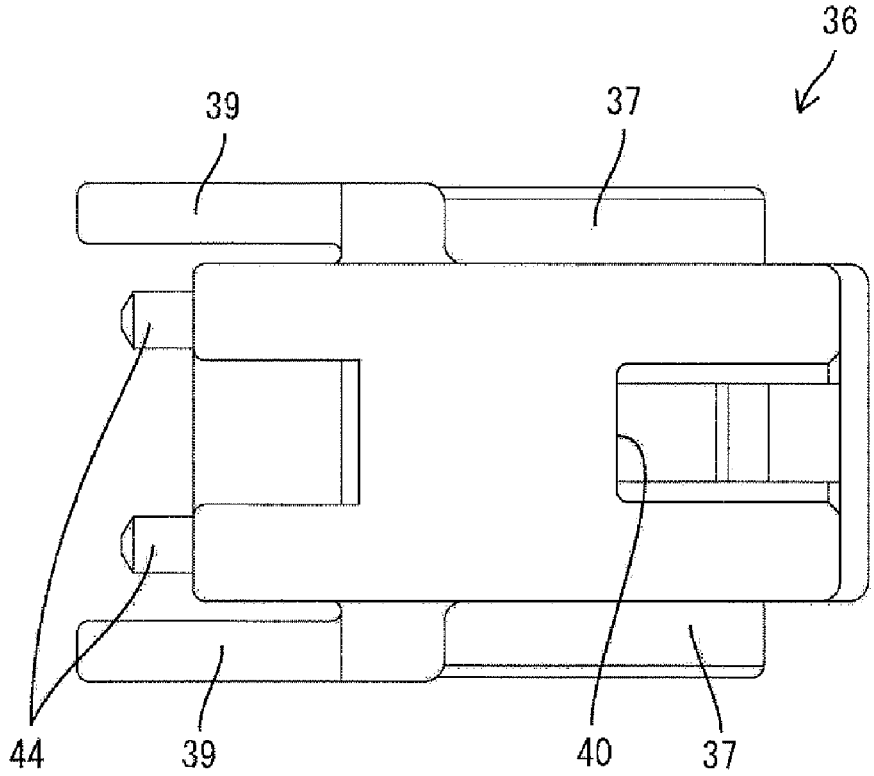
FIG. 13 is a bottom view of the movable member.
Figure 14:
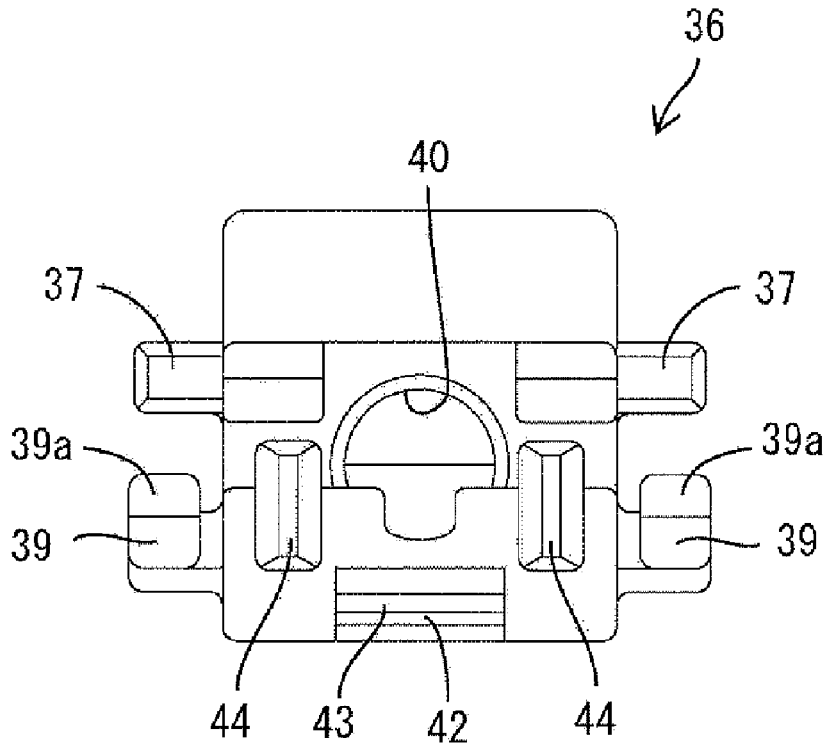
FIG. 14 is a front view of the movable member.
Figure 15:
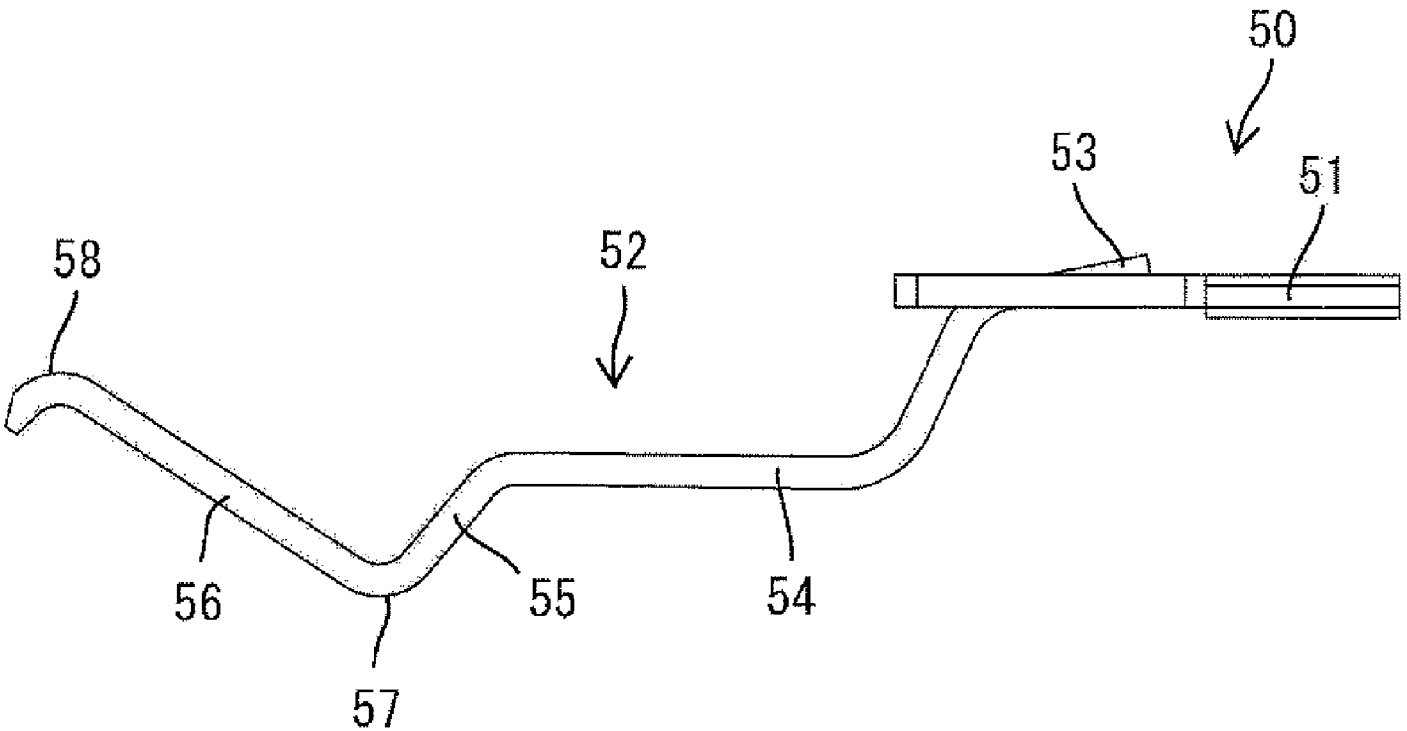
FIG. 15 is a side view of a shorting terminal.
Figure 16:
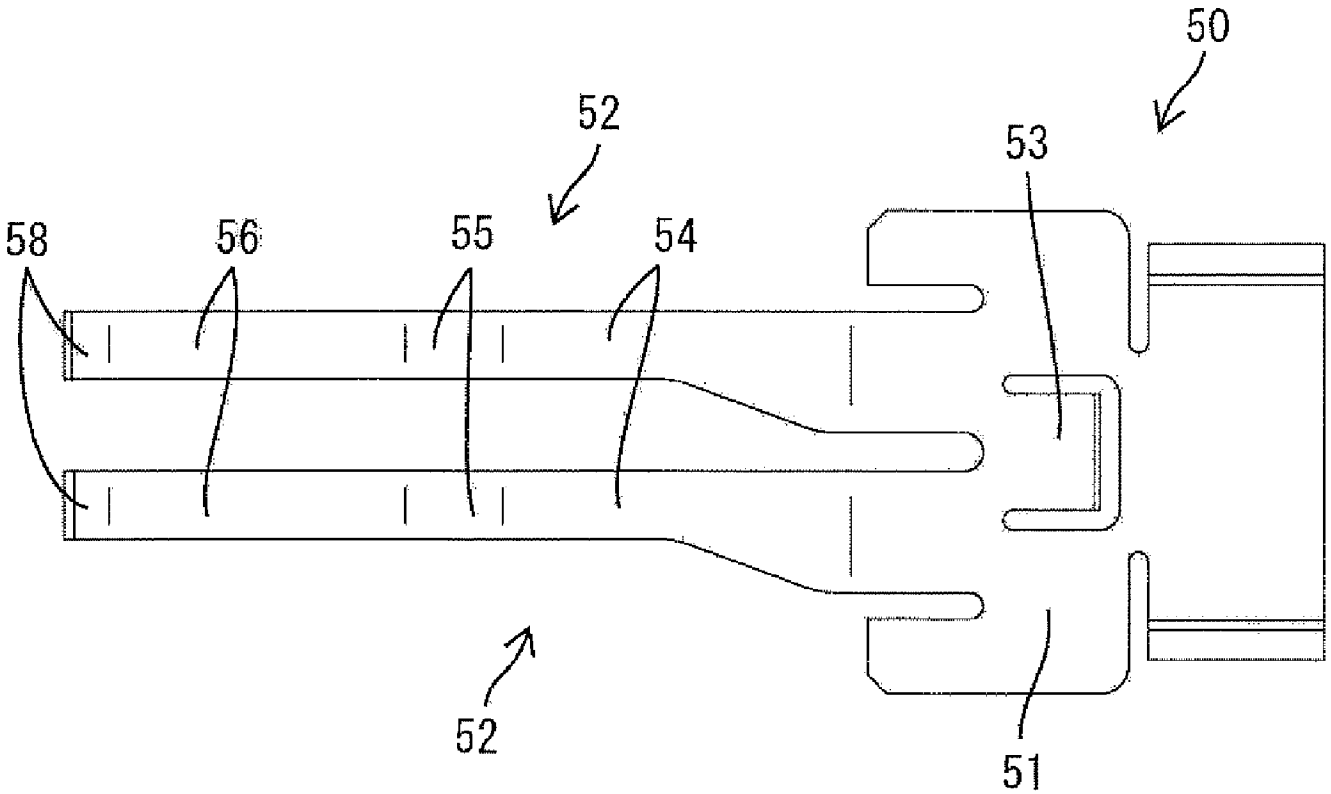
FIG. 16 is a plan view of the shorting terminal.
Figure 17:
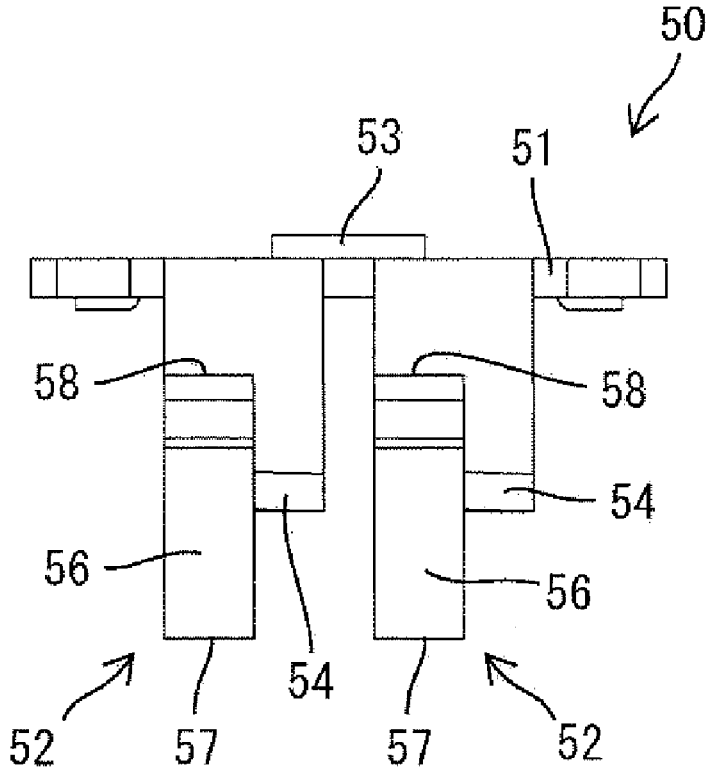
FIG. 17 is a front view of the shorting terminal.

The shorting terminal 50 includes a substantially horizontal plate-shaped main portion 51 and left and right resilient contact pieces 52 that cantilever forward from the front end edge of the main portion 51. A retaining piece 53 is cut and bent up from the plane of the main portion 51. Each resilient contact piece 52 includes a step-shaped extension 54 that projects down from the plate-like main portion 51 and then extends substantially horizontally forward. A first inclined portion 55 extends obliquely down and forward from the front end of the extension 54 and a second inclined portion 56 extends obliquely up and forward from the front end of the first inclined portion 56. The extending end of the second inclined portion 56 is bent again to extend obliquely down and forward. As shown in FIGS. 5 and 6, a first contact 57 is defined at the convex underside of the bend between the first and second inclined portions 55, 56, and a second contact 58 is defined at the convex upper side of the bend at the extending end of the second inclined portion 56.

The main portion 51 of the shorting terminal 50 is pressed into the mount groove 42 of the movable member 36 from the front until the retaining piece 53 engages the retaining projection 43. Thus, the shorting terminal 50 is positioned on the movable member 36 in forward and backward directions FBD. In this mounted position, the resilient contact pieces 52 extend forward along the bottom surface of the movable member 36 and the shorting terminal 50 can move with the movable member 36 in forward and backward directions FBD.

The connector has a switching means that includes: the compression coil springs 41 for biasing the movable member 36 towards the connection detecting position CDP; the pressing projections 16 for accommodating biasing forces in the compression coil springs 41 as the housings 10, 20 are connected; a holding means formed by the holding portions 31 and the holding pieces 39 for holding the movable member 36 at the malfunction preventing position MPP until the housings 10, 20 are connected properly; and the releasing pieces 15 for releasing the movable member 36 from the holding means so that the movable member 36 can move towards the connection detecting position CDP by the biasing of the compression coil springs 41 when the housings 10, 20 are connected properly. This switching means holds the movable member 36 at the malfunction preventing position MPP unless the pair of housings 10, 20 are connected properly and frees the movable member 36 from the malfunction preventing position MPP and permit the movable member 36 to move to the connection detecting position CDP when the housings 10, 20 are connected properly.

The movable member 36 is forward at the malfunction preventing position MPP when the female housing 20 is detached from the male housing 10. Thus, the first contacts 57 of the resilient contact pieces 52 of the shorting terminal 50 enter the cutouts 27 and resiliently contact upper surfaces of the left and right functional terminals 25. As a result, the functional terminals 25 are shorted and there is no potential difference between the functional terminals 25. In this way, a malfunction in a circuit of the functional terminals 25 is prevented.

In this state, the holding pieces 39 of the movable member 36 engage the holding portions 31 of the female housing 20 from the front to prevent backward movement of the movable member 36 towards the connection detecting position CDP. Additionally, the front ends of the guide ribs 37 contact the front ends of the guide grooves 30 from behind to prevent forward movement of the movable member 36. Therefore, the movable member 36 is held at the malfunction preventing position MPP.

The female housing 20 is fit into the receptacle 12 to connect the two housings 10, 20. As a result, the engaging portion 17 engages the lock projection 34 of the lock arm 32 and deforms the lock arm 32 down in a direction intersecting the forward and backward directions FBD. This resilient deformation of the lock arm 32 brings the front surfaces of the return receiving portions 35 into contact with the rear surfaces of the return pressing portions 44 from behind. These contact surfaces are oblique to both the moving directions (forward and backward directions FBD) of the movable member 36 and the resilient deforming directions (vertical directions) of the lock arm 32.

The pressing projections 16 of the male housing 10 contact the front ends of the compression coil springs 41 as the connecting operation of the two housings 10, 20 proceeds. However, the rear ends of the compression coil springs 41 are supported on the rear retaining walls. As a result, the pressing action of the pressing projections 16 gradually compresses the coil springs 41 so that the coil springs 41 accumulate biasing forces. The projecting pieces **16*a* at the front ends of the pressing projections 16 are fit into hollow parts of the compression coil springs 41 and prevent disengagement of the compression coil springs 41. In the meantime, the movable member 36 remains held at the malfunction preventing position MPP by the above-described holding means. The releasing pieces 15 of the male housing 10 gradually deform the holding pieces 39 resiliently down and away from the holding portions 31 as the connecting operation of the housings 10, 20 proceeds. Thus, areas of engagement of the holding pieces 39 and the holding portions 31 gradually decrease, but the holding pieces 39 and the holding pieces 31 remain engaged. The horizontal sections 14*a* of the detection terminals 14 are inserted at positions in the operation space 23 slightly above the resilient contact pieces 52 of the shorting terminal 50 as the connecting operation of the housings 10, 20 proceeds. The resilient contact pieces 52 are pressed resiliently against the functional terminals 25 and will not displace up into contact with the detection terminals 14** even if subjected to vibration.

The releasing pieces 15 deform the holding pieces 39 away from the holding portions 31 when the housings 10, 20 are connected properly. As a result, the movable member 36 is released from the movement prevented state that had been maintained by the holding pieces 39 and the holding portions 31. Thus, the resilient restoring forces accumulated in the compression coil springs 41 move the movable member 36 backward in a single stroke to the connection detecting position CDP, and the shorting terminal 50 moves back with the movable member 36. The guide ribs 37 contact the stoppers 38 to prevent backward movement of the movable member 36 and the pressing projections 16 contact the front end surfaces of the compression coil springs 41 to prevent forward shaking movements of the movable member 36 at the connection detecting position CDP. Therefore the movable member 36 is held at the connection detecting position CDP.

The lock projection 34 passes the engaging portion 17 when the housings 10, 20 are connected properly. As a result, the lock arm 32 is restored resiliently and the lock projection 34 engages the engaging portion 17 to hold the housings 10, 20 together. At this time, the biasing of the compression coil springs 41 move the movable member 36 backward, and the inclined surfaces of the return pressing portions 44 of the movable member 36 push the inclined surfaces of the return receiving portions 35 of the lock arm 32 backward. The pressing action of these inclined surfaces causes the return pressing portions 44 to impart push-up forces to the lock arm 32 so that the lock arm 32 reliably returns to an engaged state with the engaging portion 17.

The first inclined portions 55 of the shorting terminal 50 contact the rear edges of the cutouts 27 when the movable member 36 is moved to the connection detecting position CDP. As a result, the inclination of the first inclined portions 55 deform the resilient contact pieces 52 up so that the first contacts 57 move away from the functional terminals 25 and onto the upper surfaces of the partition walls 28. In this way, the shorted state of the functional terminals 25 is released. The second contacts 58 are displaced up when the resilient contact pieces 52 move onto the partition walls 28 and resiliently contact the lower surfaces of the horizontal sections 14*a* of the detection terminals 14. In this way, the shorting terminal 50 shorts the detection terminals 14 and the proper connection of the two housings 10, 20 can be detected in a detection circuit (not shown) that includes detection terminals 14.

As described above, the movable member 36 is at the malfunction preventing position MPP and the functional terminals 25 are shorted by the shorting terminal 50 unless the two housings 10, 20 are connected properly. On the other hand, the movable member 36 is moved to the connection detecting position CDP when the housings 10, 20 are connected properly. The shorting terminal 50 then shorts the detection terminals 14 and, substantially at the same time, disengages from the pair of functional terminals 25. Thus, the shorting terminal 50 is used both to short the functional terminals 25 for malfunction prevention and shorts the detection terminals 14 for detecting the connected state of the housings 10, 20. Hence, the number of parts is reduced.

A prior art connector releases a shorted state of a pair of functional terminals for the malfunction prevention before the two housings are connected properly. In such a connector, a potential difference can be produced between the functional terminals to cause a malfunction of an airbag or the like if a circuit is not closed between the housings when the shorted state of the pair of functional terminals is released.

On the contrary, the movable member 36 of this embodiment is held at the malfunction preventing position MPP and the functional terminals are shorted by the shorting terminal 50 so that the malfunction preventing state is maintained until the two housings 10, 20 are connected properly. The movable member 36 is moved to the connection detecting position CDP when the two housings 10, 20 are connected properly. Thus, the shorting terminal 50 shorts the detection terminals 14 to set a connection detecting state and, substantially simultaneously, the shorted state (malfunction preventing state) of the functional terminals 25 by the shorting terminal 50 is released. Accordingly, when the shorted state for malfunction prevention is released, the two housings 10, 20 already are connected properly and the circuit between the two housings 10, 20 already is closed. Therefore, there is no likelihood of malfunction.

The pressing projections 16 accumulate biasing forces in the compression coil springs 41 in the process of connecting the two housings 10, 20 and while the movable member 36 is held at the malfunction preventing position MPP. The biasing forces of the coil springs 41 then move the movable member 36 to the connection detecting position CDP in a single stroke when the housings 10, 20 are connected properly. In other words, the biasing forces of the coil springs 41 are imparted to the movable member 36 to move the movable member 36 reliably to the connection detecting position CDP.

Further, the partition walls 28 of the female housing 20 partition the shorting terminal 50 and the functional terminals 25 when the movable member 36 is moved to the connection detecting position CDP. Thus, the partition walls 28 partition the shorting terminal 50 and the pair of functional terminals 25 when the housings 10, 20 are connected properly. Therefore the shorted state of the functional terminals 25 by the shorting terminal 50 is released reliably.

The invention is not limited to the above described and illustrated embodiment. For example, the following embodiments are also embraced by the technical scope of the present invention as defined by the claims.

Partition walls need not be present between the shorting terminal and the terminal fittings with the movable member at the connection detecting position, and the shorting terminal and the terminal fittings may merely face each other in a non-contact manner.

The housing with the detection terminals may be a female housing and the housing with the movable member may be a male housing.

Instead of biasing forces of the compression coil springs, a pushing force from the male housing may be the means for moving the movable member from the malfunction preventing position to the connection detecting position.

What is claimed is:

1. A connector, comprising:

a housing connectable with and separable from a mating housing comprising at least one pair of detection terminals provided therein at least one pair of terminal fittings provided at least partly in the housing, a movable member provided relatively movably in the housing, and a shorting terminal movable together with the movable member and designed to come into contact with the pair of terminal fittings to short the pair of terminal fittings when the movable member is located at a malfunction preventing position and to come into contact with the pair of detection terminals having entered the housing to short the pair of detection terminals when the movable member is located at a connection detecting position.

2. The connector of claim 1, further comprising switching means for holding the movable member at the malfunction preventing position unless the pair of housings are properly connected while releasing the movable member from a held state at the malfunction preventing position and moving the movable member towards or to the connection detecting position when the pair of housings are substantially properly connected.

3. The connector of claim 2, wherein the switching means includes biasing means provided in the housing and capable of biasing the movable member toward the connection detecting position.

4. The connector of claim 3, wherein the switching means includes holding means provided in the housing for holding the movable member at the malfunction preventing position until the pair of housings are properly connected.

5. The connector of claim 1, wherein the housing includes at least one partition wall partitioning the shorting terminal and the pair of terminal fittings when the movable member is moved to the connection detecting position.

6. The connector of claim 1, wherein one or more guiding grooves extending substantially straight in forward and backward directions are formed in the housing, preferably in the partition wall thereof, wherein these one or more guiding grooves function to guide resilient contact pieces of the shorting terminal.

7. The connector of claim 1, wherein the shorting terminal is mounted to the movable member by pressing or at least partly inserting a main portion of the shorting terminal into a mount groove of the movable member.

8. A connector assembly comprising the connector of claim 1 and a mating connector connectable therewith, the mating connector having a mating housing comprising at least one pair of detection terminals provided therein.

9. The connector assembly of claim 8, wherein the switching means includes force accumulating means provided in the mating housing for accumulating a biasing force in the biasing means as the pair of housings are connected.

10. The connector assembly of claim 9, wherein the switching means includes releasing means provided in the mating housing for releasing the movable member from the held state, preferably by the holding means, and permitting the movable member to move toward the connection detecting position preferably by the biasing of the biasing means, preferably substantially at the same time as the pair of housings are properly connected.

* * * * *